United States Patent [19]

Cheng

[11] Patent Number: 4,672,351

[45] Date of Patent: Jun. 9, 1987

[54] CASSETTE TYPE CIRCUIT BREAKER

[76] Inventor: James Cheng, 2F., No. 2, Lane 79, San Chang Rd., Nan Kang District, Taipei, Taiwan

[21] Appl. No.: 719,128

[22] Filed: Apr. 2, 1985

[51] Int. Cl.[4] ..... H01H 61/00; H01H 71/18

[52] U.S. Cl. ..... 337/123; 337/130; 337/137

[58] Field of Search ..... 337/123, 124, 125, 126, 337/14, 127, 128, 129, 130, 131, 132, 133, 134, 135, 136, 139, 140, 137, 138

[56] References Cited

U.S. PATENT DOCUMENTS 3,022,402 2/1962 Arey ..... 337/137

*Primary Examiner*—Harold Broome

*Attorney, Agent, or Firm*—Lane and Aitken

[57] ABSTRACT

A base body with a big cavity in its center, a frame body encased in the cavity and retained therein by the ends of the shorter legs of the U-shaped contact plates is disclosed. During an overload condition, overheating causes a spring engaging the clipper plate to expand, which frees the frame body from the shorter legs of the contact plates and the frame body is ejected upward by a coil spring inside the frame body. The frame body is detained in the cavity of base body when freed from the shorter legs of the contact plates by engagement between flanges on frame body and the ends of the longer legs of the U-shaped contact plates, and an LED trouble indicator is used to indicate the overload condition.

9 Claims, 10 Drawing Figures

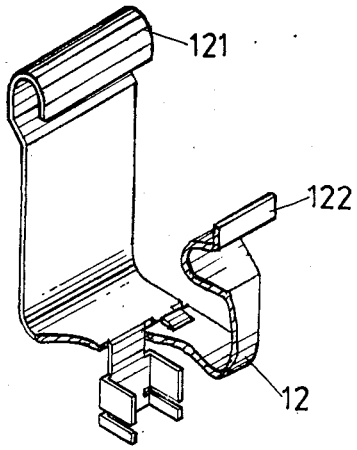
Fig. 5-a
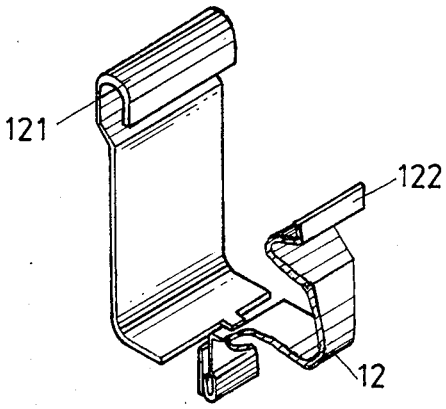
Fig. 5-b
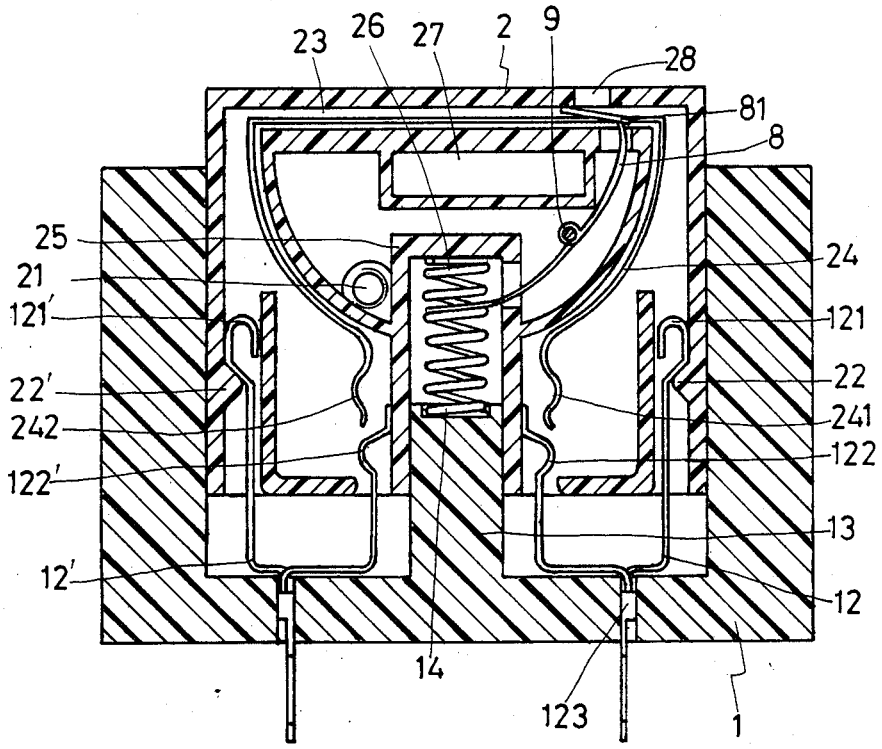
Fig. 6

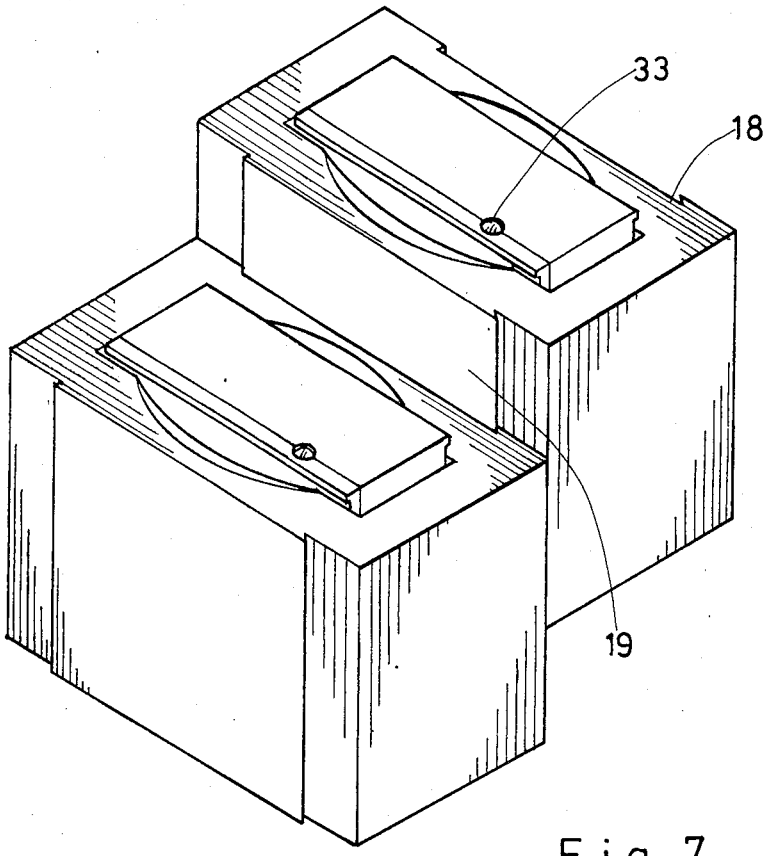
Fig. 7
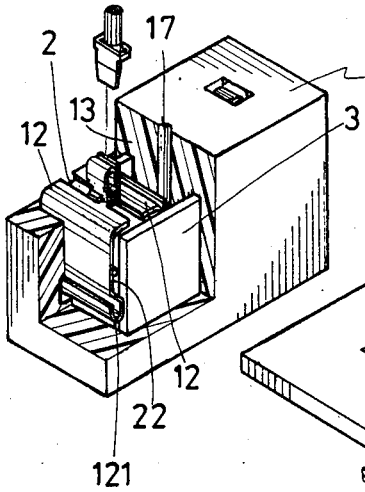
Fig. 8-b
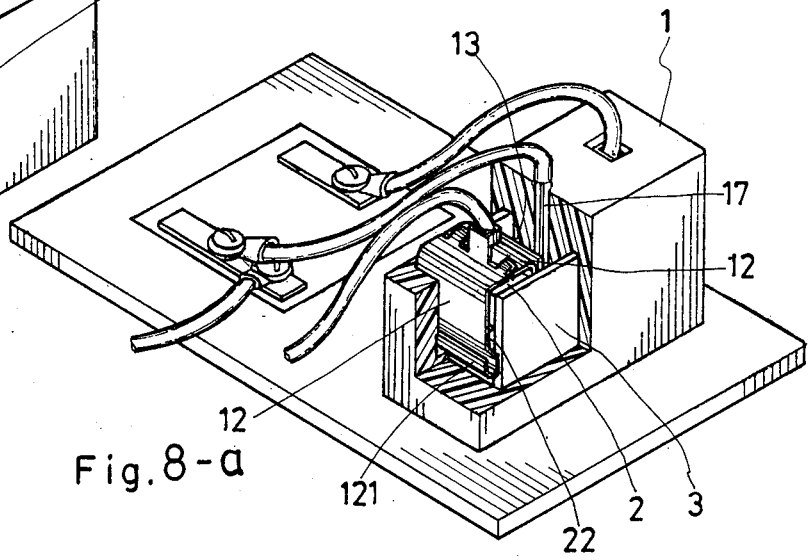
Fig. 8-a

CASSETTE TYPE CIRCUIT BREAKER

BACKGROUND OF THE INVENTION

During the utilization of an electronic or electrical appliance, troubles such as short-circuit, overload, and electric leak are likely to happen. In order to prevent accidents in which electronic or electric appliances are burned out or wiring is set fire, etc., fuse holders with fuses are provided in such appliances. Thus, when the above-mentioned troubles arise, the fuses will be burnt out and power lines cut-off. Safety is consequently maintained. But if such electronic or electric appliances are to be reused, the burnt fuses must be replaced first. To replace fuses is not only time consuming work but also involves material cost and some danger. There are fuseless circuit breakers that can be used as fuse substitutes, but they are expensive, complex in structure, large in size, and therefore, they can not be used as a substitute for all fuses.

Furthermore, there are many different fused circuits for head lights, tail lights, turn lights, brake lights, windshield wiper motors . . . etc. in an automobile. These fuses are grouped in several fuse boxes and, when an automobile is used for a long time, dust and oil will accumulate on such fuses and their identification decals so that, when one of them is burnt out, it is hard to locate it. Individual testing, one by one, is required. This increases the difficulties encountered in replacing fuses.

In view of the problems outlined above, the present invention provides a circuit breaker with an indicator which eliminates all above-mentioned defects. Not only is the replacement of a fuse no longer required, but maintenance cost is reduced and the circuit breaker itself is inexpensive.

SUMMARY OF THE INVENTION

A circuit breaker constructed in accordance with the present invention comprises a base body having a big cavity. Arc-shaped concave slots at upper opposite sides of the big cavity are provided for convenience in pulling the frame body out of the big cavity, and at the middle other opposite sides of big cavity, there are concave pits that are used to retain the longer legs of a pair of U-shaped contact plates each having one leg longer than the other leg. On outer surfaces of two opposite sides of the frame body there are two flanges, one for each outer surface. These features let the frame body be easily inserted into the big cavity of the base body, where contact hooks on a special spring inside the frame body hold the ends of the shorter legs of said pair of U-shaped contact plates against the force of a coil spring. When over-load condition exists, the special spring will release the ends of the shorter legs and the coil spring will force the frame body to jump out while said longer legs of the pair of U-shaped contact plates retain it in the base body. In one embodiment, an LED trouble indicator lights to indicate this overload condition.

BRIEF DESCRIPTION OF THE DRAWINGS

FIG. 5*a* is the perspective view of plug type U-shaped contact plates in accord with the invention.

FIG. 5*b* is the perspective view of socket type U-shaped contact plates in accord with the invention.

FIG. 6 is the cut-away view of another embodiment of trouble indicator of the circuit breaker in accord with the invention.

FIG. 7 is a perspective view of embodiment in accord with the invention.

FIG. 8 is the perspective view of a plug-type circuit breaker in accord with the invention installed on a conventional socket.

FIG. 8*b* is the cut-away view of the socket-type circuit breaker in accord with the invention.

DETAILED DESCRIPTION OF THE INVENTION

Figure 1:
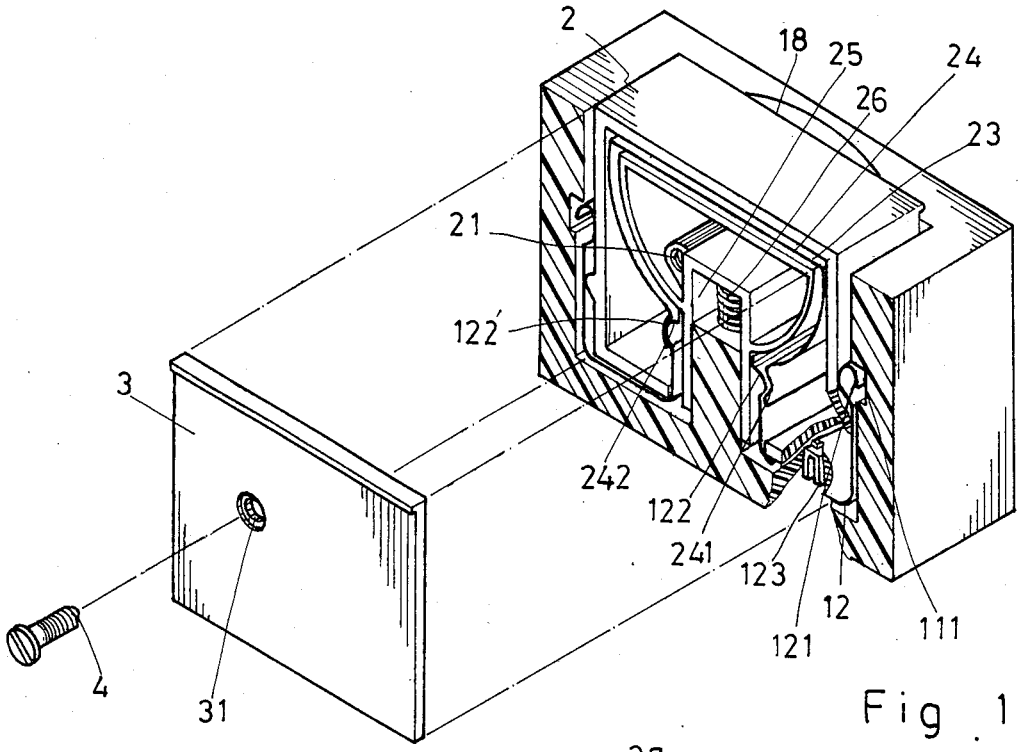
FIG. 1 is a cut-away view of the circuit breaker in accord the invention without trouble indicator.

Circuit breakers constructed in accordance with the present invention can be classified into two types: circuit breakers with a trouble indicator, circuit breakers without a trouble indicator. Both of them can be used in a conventional socket on an electric product, or as an automobile fuse, as follows:

FIG. 1 shows a cut-away view of the circuit breaker in accordance with the present invention without a trouble indicator. The base body (1), shown in cut-away view, is a rectangular parallelepiped. A big cavity (11) is provided along its center axis. On two sides of the big cavity there are concave pits (111) (111'), one on each side, and at the bottom end of the cavity (11), there are U-shaped contact plates (12) (12'). The U-shaped contact plate on one side (12) and the U-shaped contact plate (12') on the other side are symetrically structured. FIG. 5*a* is a perspective view of a plug U-shaped contact plate, and FIG. 5*b* is the perspective view of a socket-type U-shaped contact plate. The U-shaped contact plates shown in FIG. 5*a* and are about the same as U-shaped contact plates (12) and (12'). They are made of metal and are provided on each end with legs (121) (122) of different heights.

With reference to FIG. 1 again, at the center part of the U-shaped contact plate (12) a plug (123) is provided to receive a male contact plate. Also, near the top of the base body (2), there are two symetrical arc-shaped concave slots (18) opposite to each other, they are used for convenience in pulling on the frame body (2). The cavity (11) permits the insertion of the frame body (2). A protective cover (3) is provided for the frame body, an aperture (31) on the protective cover (3) is used to fix the protective cover (3) to the frame body (3) by inserting a screw (4) in a threaded bore (21) therein.

Two flanges (22) (22') are provided on the outer surfaces of frame body (2), and a concave slot (23) is provided inside the frame body. The concave slot is used to retain a special spring plate (24), e.g., a bimetal spring plate. At the two ends of the spring plate (24) are contact hooks (241) (242), one on each side. Contact hooks (241) (242) are used for the engagement of U-shaped contact plates (12) (12'). When frame body is pushed into cavity (11), contact hooks (241) (242) will be engaged on the ends of (122) (122') of U-shaped contact plates (12) (12'). FIG. 1 shows the engaged condition of the ends of the contact plates (122) (122') and the contact hooks (241) (242). At the center of the frame body (2), there is a slot (25) which houses a coil spring (26).

Figure 2:
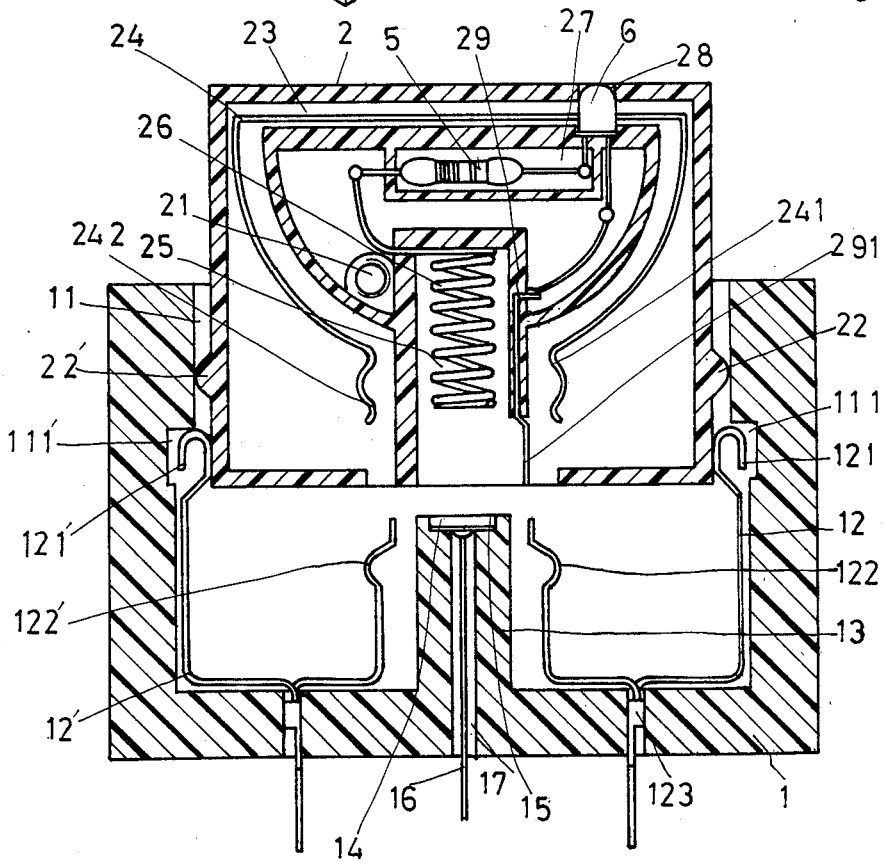
FIG. 2 is a cut-away view (1) of the circuit breaker in accord with the invention with trouble indicator.
Figure 3:
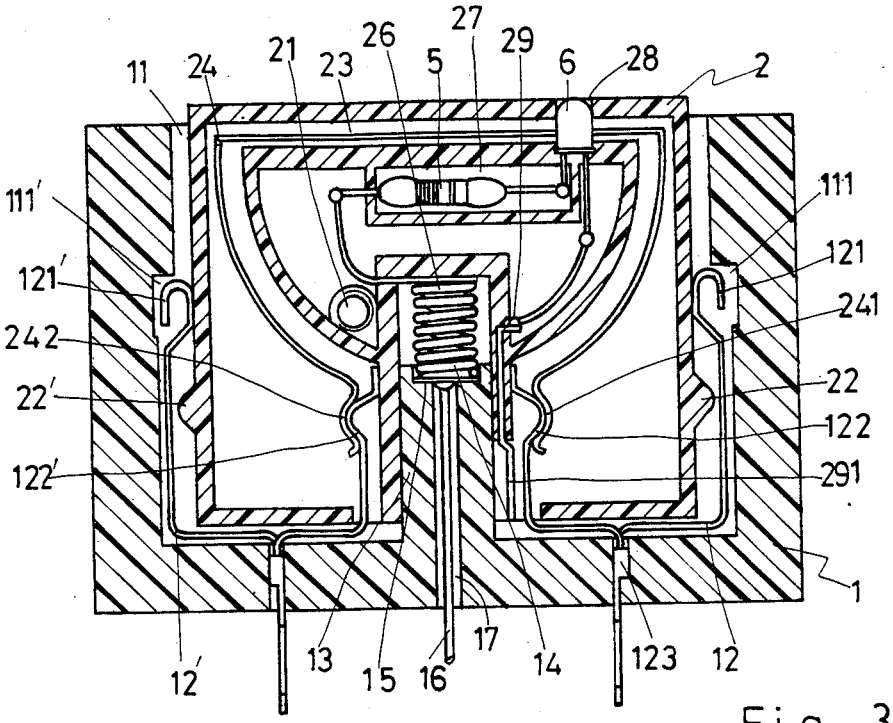
FIG. 3 is the cut-away view (2) of the circuit breaker in accord with the invention with trouble indicator.
Figure 4:
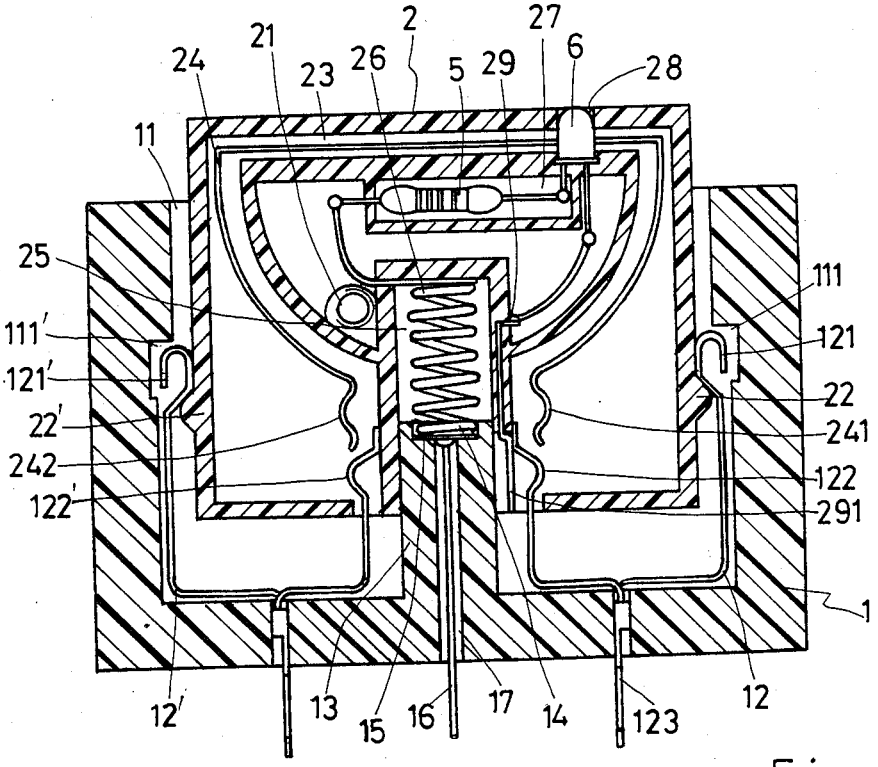
FIG. 4 is the cut-away view (3) of the circuit breaker in accord with the invention with trouble indicator.

A trouble indicator for a circuit breaker in accordance with the present invention operates as follows:

In FIGS. 2, 3 and 4 is shown a cut-away view of a circuit breaker with a trouble indicator. FIG. 7 shows a perspective view of a circuit breaker with a trouble indicator. The frame body (2) and base body (1) shown in FIGS. 2, 3 and 4 are about the same in structure as those shown in FIG. 1, and description of these similar portions need not be repeated. Its disimilar portion is the additional receptacle (27) in frame body (2) and a resistor (5) which is provided inside the receptacle (27). Furthermore, a semicircular concave slot (28) is provided on frame body (2) in which an LED indicator (6) is placed. One lead of the LED indicator is connected to a contact plate (29). This contact plate is slightly bent at its lower end, where it engages with a contact plate to which the negative pole of the power source is connected. The other lead of the LED indicator (6) is connected through a resistor (5) to the coil spring (26). When the bottom end of the coil spring (26) touches the contact plate (15) the circuit to the positive pole of the same power source is completed, which causes LED to emit light. In FIG. 7, it can be seen that the LED (6) of apparatus in accordance with the invention is clamped in the semicircular concave slot (33) of protective cover (3).

Referring to FIGS. 2, 3, 4 again, a post (13) is provided in the center portion of the base body (1). At the center of the top of the post (13), there is a concave pit (14), and a contact plate (15). A lead wire (16) is placed inside this concave pit (14), and the lead wire (16) is extended out from the base body through a hole (17) for connection to the positive pole of a power source.

FIG. 6 shows a cut-away view of another embodiment of the invention having a trouble indicator. The structure shown in this figure is about the same as aforesaid embodiment shown in FIG. 2. The only difference is in the indicator part, which is as follows:

The ends (121) (121') the U-shaped contact plates inside base body are re-located to the inner side of the frame body (2). The trouble indicator in frame body of this embodiment of this invention is a mechanical-type indicator in which a linkage lever (8) is provided to trip its action. Linkage lever (8) is fixed on an extension of the frame body (9). One end of the linkage lever (5) is affixed to a indication plate (81), and the indication plate is coloured in two tones, such as red and white, for indicating two status conditions. The other end of the linkage lever (8) is inserted between the turns of a coil spring (26). Thus, when coil spring (26) produces displacement, the linkage lever (8) is tripped, which causes indication plate (81) to change position. Thus, when the frame body (2) is pushed down, i.e. the circuit breaker indicates a safe operating status, the trouble indicator will display white colour. When frame body (2) is pushed out, due to overload, the linkage lever (8) will trip the indication plate and cause a red colour to be displayed in concave slot (28) to indicate an overload status.

FIG. 7 shows a big dovetail slot (18) and a big dovetail protrusion (19). They are used to provide mechanical linkage of the base bodies.

FIG. 8*a* shows the perspective view of a plug-type circuit breaker in accord with the invention installed on a conventional power outlet socket, FIG. 8*b* is the cut-away view of a socket-type circuit breaker.

Referring to FIG. 2 again, a cut-away view of a circuit breaker in accord with the invention wherein the frame body (2) is pushed into the cavity (11) of the base body is shown. From this figure we can see that when the frame body (2) is pushed down, the outer flanges (22) (22') are also pushed down along the inner surfaces of cavity (11) and against the ends (121) (121'), of the U-shaped contact plates which in turn forces contact hooks (241) (242) of the spring plate (24) to be aligned with and in contact with the ends (122) (122') of the U-shaped contact plates (12) (12') while the coil spring is thus compressed. Because the spring plate (24) of the invention is made with a special metal such that when electric current passes through this special metal spring plate from U-shaped contact plate (12) to U-shaped contact plate (12') heat will be generated, under overload condition a large amount will be generated and this large amount of heat will cause the special spring to open sidewise, as in a bimetal spring plate. As this heating continues, contact hooks (241) (242) will finally release the ends of the contact plates (122) (122'), and the frame body (2) will be ejected upward by the coil spring's (26) expansion force to reach the tripped condition which is shown in FIG. 4. In order to the prevent body frame (2) from being lost when ejected by the spring coil (26), the interaction of the upper ends (121) (121') of the U-shaped contact plates (12) (12') and distal flanges (22) (22') on the frame body (2) retain the frame body (2) when frame body (2) is ejected by coils spring (26), so that the frame body (2) only protrudes from the cavity (11) of the base body (1) without flying away. Once frame body (2) is ejected by coil spring (26), the lower end (291) of contact plate (29) of frame body (2) touches the end (122) of U-shaped contact plate which completes the LED circuit and letting it emit light. Thus the LED in the circuit breaker of the invention emits light when the circuit breaker of the invention is tripped OFF, and does not emit light when the circuit breaker of the invention is ON. The resistor (5) of the invention is used to prevent LED from being burnt out.

I claim:

1. A circuit breaker comprising:

a base body having a big cavity in the center of the base body with two concave pits at two sides of said cavity;

a pair of U-shaped contact plates in said base body each having a quick connector for power connection and a longer and a shorter leg, the longer legs being received in said concave pits;

a frame body received in said big cavity having a flange on each of two opposite-side outer surfaces of the frame body and a spring plate inside the frame body, said spring plate having contact hooks at two ends thereof adapted to engage the shorter legs of said contact plates so that said spring plate is connected between said shorter legs when said frame body is fully inserted in said big cavity and a coil spring in the center portion of the frame body urging said frame body outwardly from said big cavity;

the circuit breaker further including means to hold said frame body inserted in said big cavity against the force of said spring, and operable to release said frame body so that said spring can move said frame body outwardly of said big cavity disengaging said hooks from said shorter legs.

2. A circuit breaker as described in claim 1 above in which said frame body is adapted to be held within base body by an engagement of contact hooks on two ends of said spring plate with the ends of the shorter legs of said pair of contact plates.

3. A circuit breaker as described in claim 1 above in which said spring plate will generate a large amount of heat in the event of a circuit overload, and this heat will cause said contact hooks on said spring plate to expand outward, consequently releasing ends of the contact plates, and to be ejected upward by said coil spring.

4. A circuit breaker as described in claim 1 above in which, when said frame body is ejected upward in the event of a circuit overload, said frame body is still retained in said base body cavity by an engagement of ends of said U-shaped contact plates and said flanges on two opposite-side outer surfaces of said frame body.

5. A circuit breaker as described in claim 1 above further comprising a trouble indicator in which an LED indicator is connected so that said LED will emit light when said frame body is ejected in the event of an overload causing a contact plate of frame body to touch an end of said U-shaped contact plate and turn said LED on.

6. A circuit breaker as described in claim 5 above, in which, said trouble indicator LED is connected to said spring plate, and will emit light when the circuit breaker is pushed to ON and the LED will stop emitting light when the circuit breaker is tripped OFF by a circuit overload.

7. A circuit breaker as described in claim 1 above, further comprising a mechanical trouble indicator in which a linkage lever is affixed to a rod-like extension of the frame body, an indicating plate is affixed to one end of the linkage lever and the other end of the linkage lever is inserted between the coils of said coil spring so that displacement of said coil spring actuates said indicating plate, whereby circuit breaker status indication is provided.

8. A circuit breaker comprising:

a base body having a big cavity in the center of the base body with two concave pits at two sides of said cavity;

a pair of U-shaped contact plates in said base body each having a quick connector for power connection and a longer and a shorter leg, the longer legs being received in said concave pits;

a frame body received in said big cavity having a flange on each of two opposite-side inner surfaces of the frame body and a spring plate in the inner portion of the frame body, said spring plate having contact hooks at two ends thereof adapted to engage the shorter legs of said contact plates so that said spring plate is connected between said shorter legs when said frame body is fully inserted in said big cavity, and a coil spring in the center portion of the frame body urging said frame body outwardly from said big cavity;

the circuit breaker including means to hold said frame body inserted in said big cavity against the force of said spring, and operable to release said frame body so that said spring can move said frame body outwardly of said big cavity disengaging said hooks from said shorter legs.

9. A circuit breaker as described in claim 1 or 8 above further comprising a big dovetail slot on one side outer surface of said base body and a big dovetail protrusion on the opposite-side outer surface of the base body, said big dovetail protrusion and slot being adapted to provide mechanical attachment between base bodies.

* * * * *